US006020545A

United States Patent [19]

Consoli

[11] Patent Number: 6,020,545

[45] Date of Patent: Feb. 1, 2000

[54] LIGATURE FOR THE MOUTHPIECE OF A WOODWIND MUSICAL INSTRUMENT

[76] Inventor: John J Consoli, 290 Ronald Ave., Brick, N.J. 08724

[21] Appl. No.: 09/102,925

[22] Filed: Jun. 23, 1998

[51] Int. Cl.[7] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 3,410,170 | 11/1968 | Gigliotti | 84/383 R |
| 4,210,055 | 7/1980 | Platamone, Jr. | 84/383 R |
| 4,669,352 | 6/1987 | Bichon | 84/383 R |
| 4,745,838 | 5/1988 | Johnson | 84/383 R |
| 4,941,385 | 7/1990 | Johnson . | |
| 5,289,753 | 3/1994 | Rieckhoff . | |
| 5,419,229 | 5/1995 | Van Doren . | |
| 5,542,331 | 8/1996 | Hartmann et al. . | |
| 5,623,111 | 4/1997 | Van Doren et al. . | |

*Primary Examiner*—Jeffrey Donels
*Attorney, Agent, or Firm*—Woodbridge & Associates

[57] ABSTRACT

The present invention relates to a ligature used on a clarinet or a saxophone. The ligature, which is used to hold a reed to the instrument's mouthpiece, contains a plastic insert or ramp, which is riveted to the ligature by means of plastic rivets. By varying the size of the ramp different types of woodwind reeds can be accommodated. By varying the materials of the ligature, the sound emanating from the instrument can be modified in a pleasing manner.

8 Claims, 4 Drawing Sheets

LIGATURE FOR THE MOUTHPIECE OF A WOODWIND MUSICAL INSTRUMENT

FIELD OF THE INVENTION

The present invention relates to a ligature used on a clarinet or a saxophone. The ligature, which holds a reed to the instrument's mouthpiece, contains a plastic insert or ramp, which is riveted to the ligature by means of plastic rivets. By varying the size of the ramp different types of woodwind reeds can be accommodated. By varying the materials of the ligature, the sound emanating from the instrument can be modified in a pleasing manner.

BACKGROUND OF THE INVENTION

While numerous prior inventions have taught different arrangements for a ligature, such as U.S. Pat. No. 5,623,111, van Doren et al, none has taught an insert riveted to a ligature which will significantly modify the sound from a musical instrument. While Johnson, U.S. Pat. No. 4,941,385 uses a surface to hold a reed, the surface used is a cushion. In the present invention, the results are obtained from the interaction of a plastic ramp which is riveted in place. The rails in Johnson are parallel, whereas in the present invention, the "ramp" has converging rails.

OBJECTS OF THE INVENTION

It is an object of the present invention, therefore, to combine in one mechanism, a ligature for holding a reed to the mouthpiece of a musical instrument and to be able to significantly vary the quality of the music not heretofore available from a saxophone or a clarinet.

Another object of the invention is to be able to rapidly adjust the ligature.

SUMMARY OF THE INVENTION

As will become clear from the following description, the present invention produces unique sound by riveting a plastic ramp to a ligature for use with a saxophone or clarinet.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
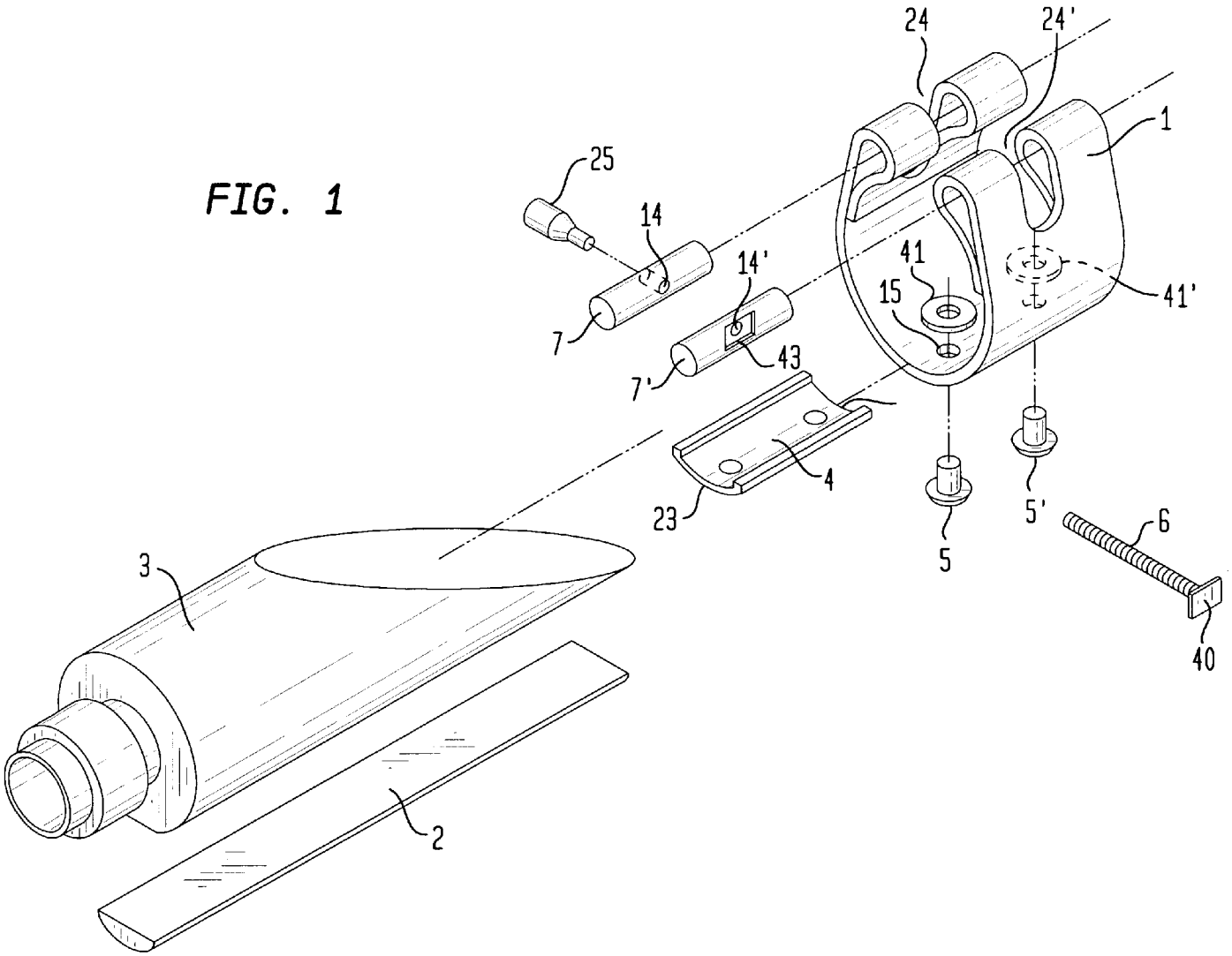
FIG. 1 is an exploded view of the invention, shown together with a reed and a mouthpiece.

Referring to the drawings of the invention as in FIG. 1, the ligature strap, 1, holds the reed, 2, to the mouthpiece, 3, by wrapping around both the reed, 2, and the mouthpiece, 3. The ligature strap, 1, is held tightly around the reed and the mouthpiece is held by a turn screw, 6, inserted through a hole, 14 and 14', in a set of locking tubes, 7 and 7', affixed to each side of the ligature. A knob, 25, is used to tighten the turn screw. One of the tubes has a square cut in its side, 43. The turn screw, 6, has a square tab, 40, slightly smaller than the square cut, affixed to its end. The square tab locks in place when the knob is used to tighten the turn screw.

Figure 4:
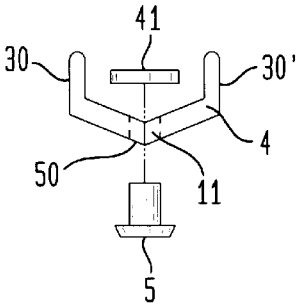
FIG. 4 is a section of the ramp, showing a rivet.
Figure 5:
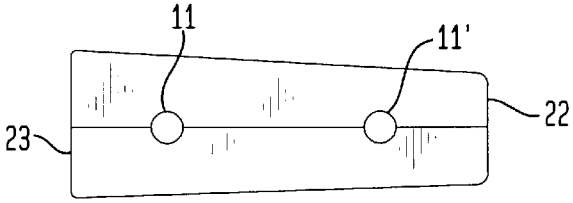
FIG. 5 is a top view of the ramp.

A plastic ramp, 4, in the shape of an "inverted cross-section of a house", as shown in section in FIG. 4, and riveted to the ligature strap by plastic rivets, 5, creates a unique sound that is unusual and extremely pleasing when used in connection with a saxophone or a clarinet. Locking washers, 41 and 41', are bonded to the end of the rivets, as seen in FIG. 1. As further seen in FIG. 4, the ramp, 4, is shown to have side rails, 30 and 30', and a "V" shaped bottom, 50. As seen in FIG. 5, the ramp, 4, tapers slightly lengthwise, with the narrower end, 22, positioned towards the mouthpiece tip and the wider end, 23, positioned towards the instrument. The ramp, 4, contains a pair of rivet holes, 11 and 11', along its length at the centerline.

Figure 2:
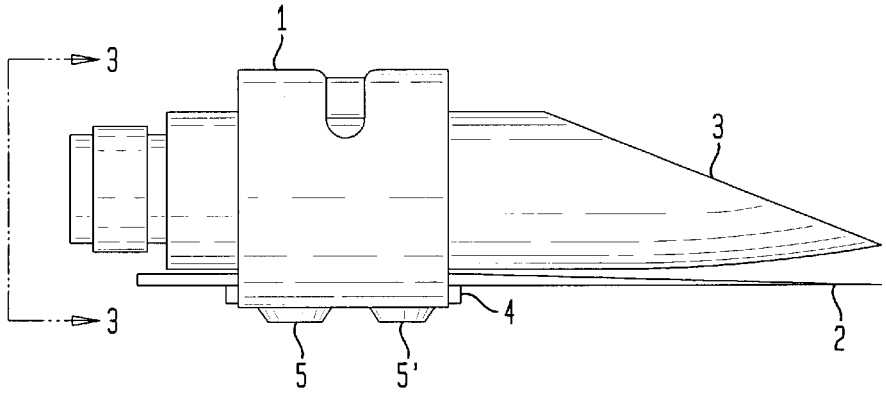
FIG. 2 is an elevation view of the invention affixed to a reed and a mouthpiece.

FIG. 2, shows the ligature strap, 1, tied in place around a mouthpiece, 3. The ramp, 4, is held in position by a pair of plastic rivets, 5 and 5'. It has been found in practice that the plastic rivets contribute to the sound made by the invention. On the other hand glue or metal rivets tend to dull the sound. As can be seen, the reed, 2, is secured between the ramp, 4, and the mouthpiece, 3. A turn screw, 6, passing through the top of the ligature is used to adjust the tightness around the reed and the mouthpiece. The musician makes this adjustment to suit their requirements.

Figure 3:
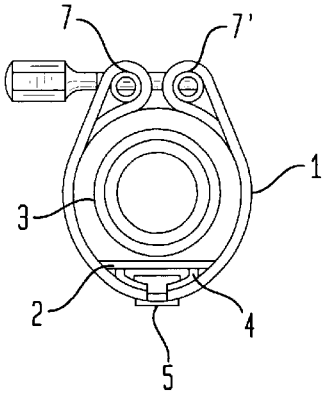
FIG. 3 is a section of FIG. 2.

A cross section of the invention tied in place is shown in FIG. 3.

The ramp, 4, is shown in cross-section in FIG. 4. As can be seen, the shape of the ramp is in the form of an inverted house, having two side rails, 30 and 30', and a "V" section, 50. As is further seen, a rivet, 5, and a washer, 41, are fitted in a hole, 11, in the bottom of the "V".

FIG. 5, shows a top view of the trapezoidal shaped ramp, showing a long end, 23, and a short end, 22. Holes, 11, and 11', are shown to receive the rivets for attachment to the ligature strap.

Figure 6A:
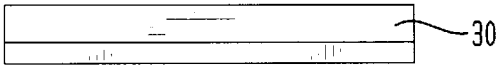
FIG. 6A is an elevation view of a shortened ramp.
Figure 6B:
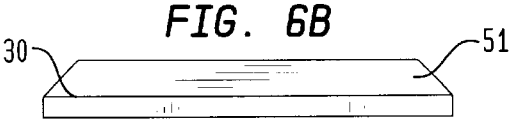
FIG. 6 is an elevation view of the ramp.

FIG. 6, shows an elevation view of the ramp. As can be seen the shape of the rails, 30, are rectangular. This shape is generally used with a saxophone. But, as seen in FIG. 6A, if the rail, 30, is shortened on its top edge, 51, the ramp can be used for a clarinet. By varying the length of the top of the rail, 51, the invention can accommodate either a clarinet or a saxophone.

Figure 7:
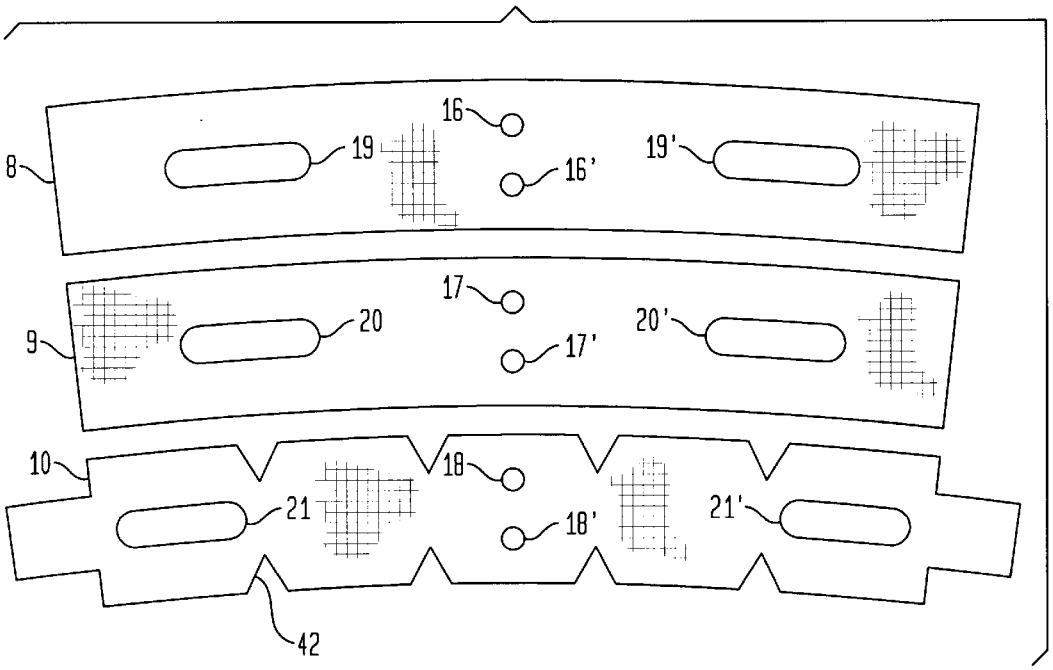
FIG. 7 is a view an embodiment of the ligature unassembled, showing the various elements.
Figure 8:
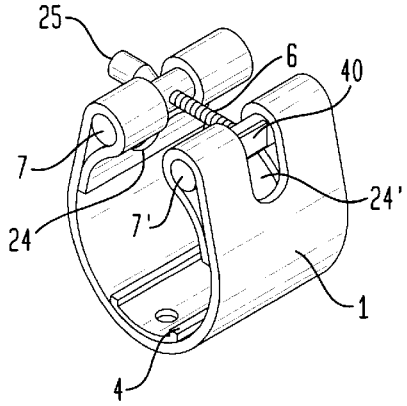
FIG. 8 is a perspective assembly view of the invention.

The ligature strap, in one embodiment of the invention, as seen in FIG. 7, is composed of three layers of material, having a curvilinear shape. Both the inside layer, 8, and outside layer, 10, are made of a MYLAR material. The center layer, 9, is made of a fiberglass mesh material. As is seen in FIG. 8, the ends of the ligature layers are folded back around the locking tubes, 7 and 7', and sewn or glued in place. The curvilinear shape allows the ligature to be better fit around the mouth piece and reed assembly.

In FIG. 7, it is seen that elongated holes, 19 and 19', 20 and 20', and 21 and 21', are cut into the inside, middle, and outside layers, respectively, of the ligature strap. A multiplicity of notches, 42, are cut on each side of the outside layer to ease assembly.

FIG. 8, shows that the holes formed above, here 24 and 24', provide access for the turn screw, 6, and the locking tubes, 7 and 7'. In addition, a pair of circular holes, 16 and 16', 17 and 17', and 18 and 18', are cut transverse at the center of the inner layer, 8, the middle layer, 9, and the outside layer, 10, to allow for the rivets.

Figure 9:
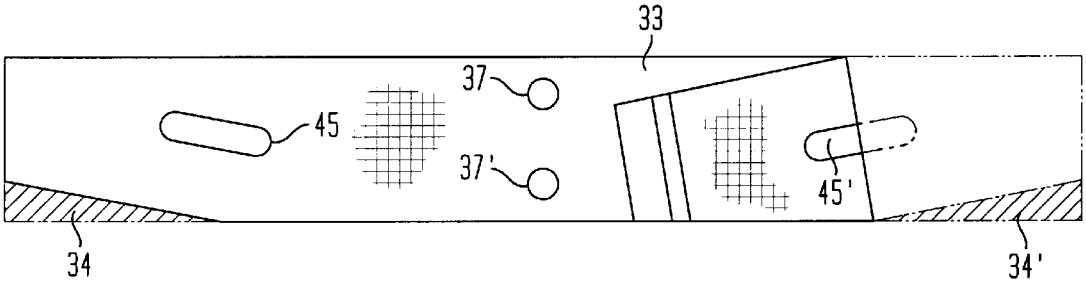
FIG. 9 is a layout of the preferred embodiment of the ligature, showing the location of the holes, the cutoff piece, and one end folded over.
Figure 9A:
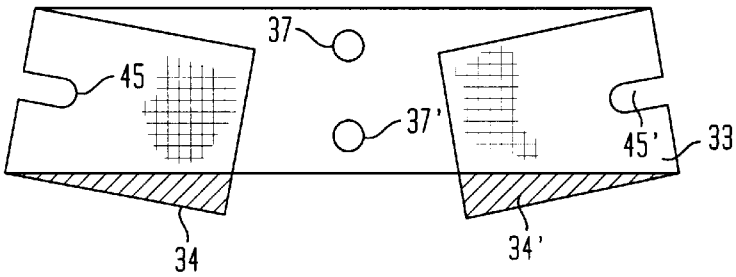
FIG. 9A is a layout of the preferred embodiment of the ligature, showing the ends folded over.

FIG. 9, shows the preferred embodiment of the ligature, 33, which is a single piece cut in the form of a rectangle. In this embodiment, the ends are folded underneath at an angle or bias, with the edge 34 and 34', respectively cut off The rivet holes are shown as 37 and 37' and the elongated holes are shown as 45 and 45'. FIG. 9A, also indicates the relative position of the holes 37 and 37', and 45 and 45', respectively, but with the ligature, 33, stretched out.

What I claim is:

1. A ligature apparatus used around the mouthpiece and reed of a woodwind instrument comprising:

a ligature strap having a curvilinear shape consisting of three layers of the same size and shape joined together, said three layers including an inner layer and an outer layer made of a thin MYLAR® material and a middle layer made of a thin fiberglass mesh, such that elongated holes located at the ends of said strap are cut through the three layers and a pair of circular holes are cut transverse at the center of the strap, both the ends being looped backward and affixed to the strap by an attachment means;

a plastic ramp, trapezoidal in shape lengthwise, having a "V" shaped bottom and raised side rails, said ramp having a narrow end and a wide end, with a pair of holes through the center of the bottom;

a pair of plastic rivets, having a hemispherical shaped end, one surface of which is flat, with a cylindrical projection affixed perpendicularly and centrally to the flat surface and said projection having an open end, passing through the holes in the ramp and through the center holes in the ligature strap and having a means of affixing said rivets to the ramp and the ligature, such that when the ramp is affixed to the ligature, the narrow end of the ramp is positioned towards the mouthpiece tip and the wide end positioned toward the instrument;

a pair of locking cylinders, having a lengthwise axis, and a hole perpendicular to the lengthwise axis, said cylinder passing through the ligature strap loops;

a locking screw passing through the holes in the locking tubes, such that the ligature can be tightened around the reed and mouthpiece.

2. The ligature in claim 1, wherein:

one of the locking cylinders has a square hole partially cut into the surface at one end of the perpendicular hole;

the locking screw having a flat square plate slightly smaller than the square hole partially cut into the surface of the tube, such that the square plate fits into the square hole and causes the locking screw to be fixed in place when said screw is tightened.

3. The ligature in claim 1, wherein:

the ligature strap having a rectangular shape, having a centerline along its surface, two short edges at its ends and two long edges at its sides, and having elongated holes close to each end, such that the holes are positioned at an angle to the centerline of the strap, said end being folded over at a bias, such that the elongated holes overlap when folded over, said ends being joined to the surface of the strap to form a loop, with the excess overlap being cutoff, having two rivet holes central to the strap and on a line perpendicular to the centerline of the strap.

4. The ligature in claim 1, wherein:

the plastic ramp has the ends of the side rails reduced in size to fit an alternative instrument.

5. A ligature apparatus for use around the mouthpiece and reed of a woodwind instrument comprising:

a ligature strap having a first end and a second end;

a plastic ramp, trapezoidal in shape lengthwise, having a "V" shaped bottom and raised side rails, said ramp having a narrow end and a wide end;

attaching means for attaching said ramp to said ligature strap; and, ligature tightening means attached to said first and second ends of ligature strap for tightening said ligature around said reed and mouthpiece.

6. The ligature apparatus of claim 5 wherein said raised side rails comprise a first and second side rail disposed in converging relationship to each other.

7. A ligature apparatus for use around the mouthpiece and reed of a woodwind instrument comprising:

a ligature strap having a first end and a second end;

a plastic ramp, trapezoidal in shape lengthwise, having a first and second side rail on opposite sides thereof, said side rails being continuous and disposed in a converging relationship with respect to each other, said ramp further having a narrow end and a wide end;

attaching means for attaching said ramp to said ligature strap; and, ligature tightening means attached to said first and second ends of said ligature strap for tightening said ligature around said reed and mouthpiece.

8. The ligature apparatus of claim 7 wherein said plastic ramp includes a "V" shaped bottom.

* * * * *